US007001111B2

(12) United States Patent
Maxwell et al.

(10) Patent No.: US 7,001,111 B2
(45) Date of Patent: Feb. 21, 2006

(54) LANDSCAPE/EROSION CONTROL PRODUCT

(76) Inventors: Victoria H. Maxwell, 2124 Edington Pl., El Dorado Hills, CA (US) 95762; Kathleen R. Garcia, 4841 Danbury Cir., El Dorado Hills, CA (US) 95762

( * ) Notice: Subject to any disclaimer, the term of this patent is extended or adjusted under 35 U.S.C. 154(b) by 0 days.

(21) Appl. No.: 10/692,941

(22) Filed: Oct. 24, 2003

(65) Prior Publication Data

US 2005/0089376 A1 Apr. 28, 2005

(51) Int. Cl.
*E02D 17/20* (2006.01)

(52) U.S. Cl. ..... 405/302.6; 405/302.7; 405/15

(58) Field of Classification Search ..... 405/302.6, 405/302.7, 302.4, 15, 16, 17
See application file for complete search history.

(56) References Cited

U.S. PATENT DOCUMENTS

| | | | | |
|---|---|---|---|---|
| 763,503 | A | | 6/1904 | McGregor |
| 2,464,301 | A | | 3/1949 | Francis, Jr. |
| 2,740,233 | A | | 4/1956 | Reynolds |
| 2,822,644 | A | | 2/1958 | Berger |
| 3,181,273 | A | | 5/1965 | West et al. |
| 3,305,969 | A | | 2/1967 | Mattson |
| 3,315,408 | A | | 4/1967 | Fisher |
| 3,517,514 | A | | 6/1970 | Visser |
| 3,555,728 | A | | 1/1971 | Herns |
| 3,805,446 | A | | 4/1974 | Aoyagi |
| 3,870,583 | A | | 3/1975 | Gidge |
| 3,955,319 | A | | 5/1976 | Smith |
| 4,062,145 | A | | 12/1977 | Gidge |
| 4,181,450 | A | | 1/1980 | Rasen et al. |
| 4,190,981 | A | | 3/1980 | Muldner |
| 4,304,069 | A | | 12/1981 | Kobayashi |
| 4,342,807 | A | | 8/1982 | Rasen et al. |
| 4,353,946 | A | | 10/1982 | Bowers |
| 4,794,726 | A | | 1/1989 | Fawcett et al. |
| 4,984,384 | A | * | 1/1991 | Kaufmann ..... 405/302.6 |
| 5,070,641 | A | | 12/1991 | Brockington |
| 5,232,759 | A | | 8/1993 | Golze |
| 5,258,217 | A | | 11/1993 | Lewis |
| 5,307,588 | A | | 5/1994 | Ullmann |
| 5,584,600 | A | * | 12/1996 | Langdon ..... 405/302.6 |
| 5,644,998 | A | | 7/1997 | Krolick |
| 5,651,641 | A | | 7/1997 | Stephens et al. |
| 5,849,645 | A | | 12/1998 | Lancaster |
| 5,855,090 | A | | 1/1999 | Reum, Sr. |
| 6,094,860 | A | * | 8/2000 | Motz et al. ..... 405/302.7 |

OTHER PUBLICATIONS

Declaration of Victoria H. Maxwell and Kathleen R. Garcia, "Hydro Seeding a Slope with Various Types of Vegetation or Seed Mixes and Adding Straw, " total of 1 page.

(Continued)

*Primary Examiner*—Frederick L. Lagman
(74) *Attorney, Agent, or Firm*—James R. Cypher; Charles R. Cypher

(57) ABSTRACT

An improved erosion control system has a field of spines disposed on a support structure. The spines capture landscaping material that is placed on top of the erosion control system, hiding the landscape/erosion control system. The spines are arranged in relation to each other and to the lower support structure such that spaces exist between most of the distal portions of the spines, and the spines are relatively stiff such that the distal ends of the spines stand away from the lower support structure when in a rest position to capture the landscape material.

78 Claims, 8 Drawing Sheets

OTHER PUBLICATIONS

Declaration of Victoria H. Maxwell and Kathleen R. Garcia, "Hydro Seeding a Slope with Various Types of Vegetation or Seed Mixes, " total of 1 page.

Declaration of Victoria H. Maxwell and Kathleen R. Garcia, "Using Rope Netting in Combination with Landscape Material, " total of 1 page.

Easy Gardner, "WeedBlock" , Easy Gardner, total of 3 pages, (2001).

Declaration of Victoria H. Maxwell, "Weed Block Brand Landscape Fabric Sold by Easy Gardner, Inc., " total of 1 page.

Tenax UK Limited, "Netting, Mesh & Fabrics, " WeedStop, Tenax UK Limited, total of 3 pages.

Ted Cushman, "Smarter Site Work with Geosynthetics" , The Journal of Light Construction (U.S.A.), front page, p. 57-63, (May, 2003).

D-Drain Water Drainage System. Web pages at: hhtp://www.dewittcompany.com/., copyright 2004, downloaded Nov. 1, 2004, 6 pages, DeWitt, 905 S. Kingshighway, Sikeston, MO 63801, 1 800 888 9669.

"Agru's Super Gripnet Liner Cap's A Landfill in Pennsylvania, USA", Project Report #1, 2 pages, Agru/America, Inc., 500 Garrison Road, Georgetown, SC. 29440, USA Publication Date: at least as early as Jul. 13, 2004.

* cited by examiner

LANDSCAPE/EROSION CONTROL PRODUCT

BACKGROUND OF THE INVENTION

The present invention relates to a landscaping/erosion control structure in the form of a series of spines which can be attached to opaque fabric, open weave fabric or an open mat as a method of capturing and retaining landscape bark, straw or other similar materials that are desired to be captured and retained on a slope for a variety of applications.

While the materials of this invention have many other diverse applications, they have been primarily designed to embody unique characteristics which are important in landscape fabric/erosion control uses and particular emphasis is placed on such uses throughout this application. The term 'landscape fabric' is used throughout this application to define a light blocking material containing micro pores to allow the passage of water. The term "open mat" is used throughout this application to define a landscape fabric with and open grid. The term "adhesion" may also mean glue.

There is a need for a long lasting and/or reusable device for and method of capturing and retaining materials on a slope that can be easily manufactured, rolled, shipped and placed in position.

PRIOR RELATED ART

There are many prior art patents related to channel lining erosion control methods and water erosion control.

U.S. Pat. No. 5,855,090 discloses an improved landscape fabric that suppresses weed growth but allows the passage of air and water. The fabric is thicker than conventional landscape fabric and is designed with ridges and valleys.

U.S. Pat. No. 5,651,641 discloses an erosion control product that is an open weave mat with tufted, looped fibers which are manufactured with carpet tufting machinery or plastic extrusion. The open mats can be seeded or buried in the earth for soil retention from high water flow areas.

U.S. Pat. No. 3,517,514 discloses a system of revetment mats having randomly oriented loose fibers or tufts protecting the earth from flowing waters and for preventing the washing away of loose soil from river bottoms and tidal waters. The fibers and mats are designed to capture mud particles from high water flow areas.

These three patents have a very different purpose, use and design characteristics from the current invention. The disadvantages of the prior art in its use for residential and commercial sloped areas are numerous. The long loose fibers in U.S. Pat. No. 3,517,514 would be weighted down by bark and other landscape materials. It would not retain its shape and hold four to six inches of bark or straw. U.S. Pat. No. 5,651,641 has loops, and these loops are randomly oriented being disposed in every possible direction. The loops would make it extremely difficult to spread landscape materials over the top with a tool such as a rake during the initial spreading of the materials. It would also be nearly impossible to remove and store the landscape material, if it was not needed for a period, because it would be difficult to remove the materials to reuse the fabric. The disadvantage of U.S. Pat. No. 5,855,090 is that if used on a slope, the ridges of this particular invention would act as a flat surface of opaque fabric which like other flat weed suppressing mats would become bald over time, exposing the ridges to show rows of black fabric. This would be unsightly for landscape barked areas. Straw would simply blow away on the high ridges of the fabric.

Currently, many homeowners who live in hilly areas have sloped sections of yard that are difficult to landscape and maintain. Sloped areas often have difficult access and are also difficult to ambulate depending on the degree of slope to be landscaped.

The inventors are aware of at least three commonly used methods of preventing weeds from growing and keeping landscape bark on a slope.

One method is to lay down bark or mulch. This helps to prevent weed growth while at the same time beautifies the sloped area of land. The disadvantage is that weeds are still able to reach the soil and grow through the bark eventually requiring manual or chemical removal, both of which are costly and labor intensive.

Another method is to first place a landscape fabric down and then apply the bark. This method helps to control weeds but does nothing to retain the bark on the slope.

The third method is to first lay the landscape fabric, then lay down rope netting and then the bark on top of both.

The disadvantages of the last method are numerous. One, there are several steps and at least two separate rolls of materials are needed to complete the job. The next disadvantage is that over time the rope netting disintegrates and wind, rain, gravity and foot traffic erode the rope netting leaving bald spots on the slope with shiny unattractive black landscape fabric showing through. This creates a problem in that the netting needs to be replaced periodically and then more bark needs to be added. Even if the netting used is a non-degradable product, it still does not work well to hold the material on the slope.

Both of the last two commonly practiced methods are costly and labor intensive to maintain. Most homeowners would appreciate a product that would not only prevent weeds but also hold and trap landscape materials to the slope.

One advantage of the present invention is that the preferred material for the spines of the present invention is a UV resistant, non-porous polyethylene which will resist decay, last for a long time although it is exposed to the elements, and can be reused.

The spines of the present invention are preferably strong and stiff yet will bend or flex somewhat. The spines of the present invention are also preferably set at an angle to their underlying support structure so as to better trap material on a slope and also to better be able to be compressed when rolled up with the underlying support structure to reduce the storage volume needed.

By using spines set in an underlying support structure to capture mulch, slippage of the landscaping materials such as bark, mulch or hay is prevented. This promotes a clean, completely covered uniform appearance which will last for years to come, eliminating excess chemical control and frequent manual labor. The present invention is also easily manufactured and is preferably produced in rolls for ease of use and storage.

In the preferred embodiment, the spines are designed to set at an acute angle to the fabric or mat when the fabric or mat is rolled out flat, and the spines are not being pressed upon by the rolls of the mat or anything else. The spines are designed to be compressed or lay nearly flat during shipping but will return to their rest position or preferred angle of nearly thirty to forty degrees after the fabric or mat or other structure carrying the spines is placed on the slope. Once the landscape materials are added, the weight of the landscape materials may bend the spines farther away from the landscape fabric or mat, but typical landscape covering materials should not be able to bend the spines past 90 degrees.

Other systems of erosion control on slopes, known to the inventors and which are believed to be currently used, consist of hydro seeding the slope with various types of vegetation or seed mixes. The primary disadvantage of this method is that in heavy rainfall, unless the seeds have already germinated and taken root, they tend to wash away. Another disadvantage is that the seeds need time to take root, which would not allow this system to be used at times where protection is needed immediately. In these situations one method currently implemented is to simply cover the slope with straw. The straw can be blown away with wind or washed away with rain. Tacifiers are also used to adhere the straw to the slope. However, as the adhesive quality of the tacifier decays, the straw becomes loose. Another disadvantage of the above methods is that slippage occurs if the soil on the slope is disturbed.

In the present invention, the improved landscaping/erosion control structure is formed as a field or matrix of discrete spines of uniform or varying lengths that can capture and retain landscape materials. The spines can be used on different support structures giving the user the opportunity to use the spines of the present invention with a landscape fabric to block the transmission of light to disallow growth, or with an open mesh or mat structure material that does not necessarily block the transmission of sunlight or disallow growth, but will protect the hillside or slope.

As contemplated by the inventors, it is believed that the spines will normally be set in place on the ground to be protected with the spines disposed above the underlying support structure.

The object of the present invention is to provide a simple, easily installed, UV resistant, inexpensive and reusable method for retaining landscape bark, straw, mulch or other similar materials that are desired to be captured and retained on a slope. This invention retains all of the desirable features of a landscaping/erosion control structure while at the same time being easily and inexpensively manufactured and installed. The novel features and characteristics of the invention are set forth particularly in the claims herein. Additional objects and advantages will be set forth in the description and drawings.

SUMMARY OF THE INVENTION

It is therefore a general object of the invention to overcome the above described limitations and other problems associated with capturing and retaining materials on slopes for landscape/erosion control purposes.

The present invention consist of a matrix or field of spines which are attached by a variety of means to an underlying structure. The underlying structure can include landscape fabric, open mesh weave or open mat material. The present invention is primarily meant to retain landscape bark, mulch, straw or any other similar materials that are desired to be captured and retained on a slope for landscaping/erosion control purposes, although other uses are not outside the scope of the invention.

In one embodiment of the invention the spines are placed upon a landscape fabric for the purpose of retaining material such as landscape bark on a slope while blocking or substantially blocking the transmission of light to disallow growth of vegetation. The length of the spines and spacing of the spines on the fabric may vary depending upon the application.

In another embodiment, the spines are attached to an open mesh weave or open mat material for the purpose of retaining material on a slope but to not necessarily block the transmission of light or disallow growth but for the purpose of retaining straw or similar material meant to be held on a slope for a variety of storm water protection/erosion control purposes.

In another embodiment, the spines are cut out from a sheet of material and bent back to the desired angle. A landscape fabric material can then be attached to the bottom of the top sheet to disallow the transmission of light if desired. The length of the spines and spacing of the spines on the open mesh weave or open mat material may vary depending upon the application. The landscape fabric and/or open mesh weave or open mat material is formed into sheets of predetermined length, width and thickness and formed from materials which are flexible enough to easily allow rolling for storage or shipment without fracture or breakage. The sheets are easily rolled out on the slope.

In one embodiment, sheets with a particular arrangement of spines and edge contour can be used so as to better prevent gaps in the spines to assure full coverage of the landscape material. In this embodiment, the sheets are formed with protruding sections along the outer edges of the sheets.

The sheets can be anchored to the slope by placing pegs in preformed holes in the material or by puncturing through the material.

The present invention provides a means to capture and retain material on a slope allowing full coverage on a slope by which the material being retained cannot easily wash away by rain, wind or foot traffic. This is achieved in a cost effective manner and is easily manufactured and installed with the important advantage of reusability.

DETAILED DESCRIPTION OF THE INVENTION

Figure 1A:
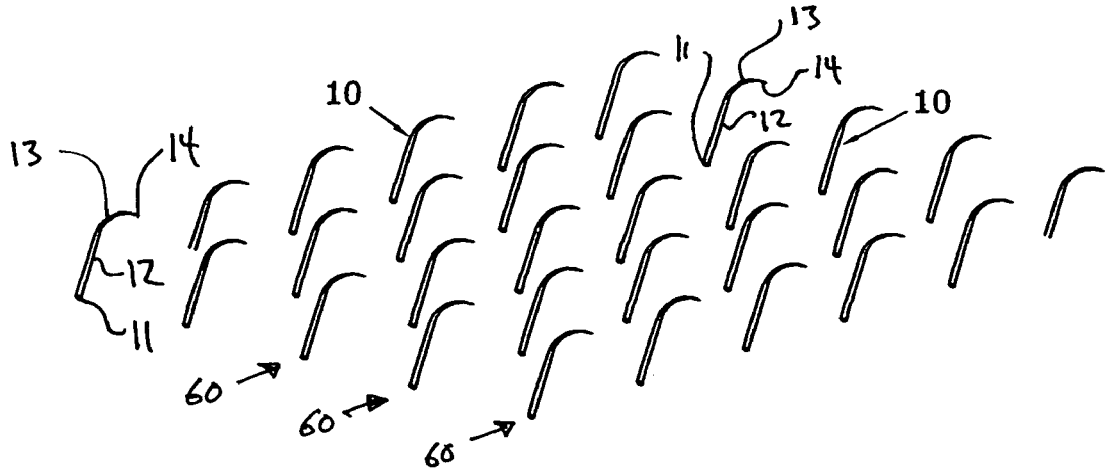
FIG. 1A is a perspective view of the spines of the present invention with a sickle-shaped curvature at the end of the spine.

Embodiments of the present invention described and illustrated by figures thus far show many, but not all, of the various combinations with which the elements of the present invention can be assembled.

The present invention generally comprises a matrix or field of spines 10 for the function of capturing and/or retaining various materials 81. The present invention has particular use on sloped surfaces 82. Embodiments utilizing the spines 10 may be better understood from the following description given in connection with the accompanying drawings.

The preferred material for the spines 10 of the present invention is a UV resistant, non-porous polyethylene which will resist decay, last for a long time although it is exposed to the elements, and can be reused. It is also possible to make the spines 10 from other similar materials or a combination of materials. The plastic spines 10 of the present invention could be reinforced with metal, carbon or other similar materials.

The spines 10 of the present invention are preferably strong and stiff yet will bend or flex somewhat. The spines of the present invention are also preferably set at an angle to their underlying support structure 15 so as to better trap material 81 on a sloped surface 82 and also to better be able to be compressed when rolled up with the underlying support structure 15 to reduce the storage volume needed. The preferred angle is approximately 45 degrees, and is the angle of the basal portion 12 to the lower support structure 15, when the spine 10 is in the rest position.

Figure 1B:
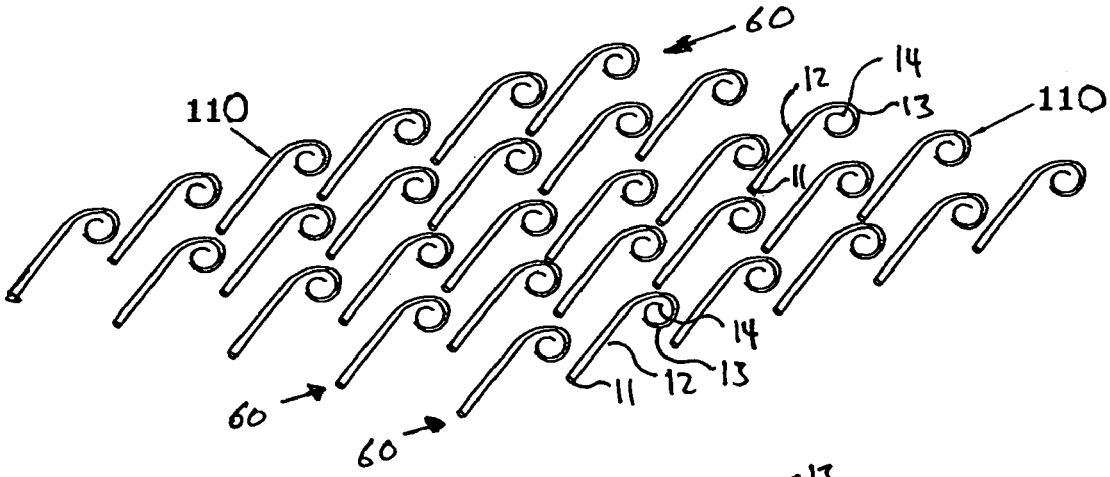
FIG. 1B is a perspective view of the spines of the present invention of alternative shape having rolled portions near the ends of the spines.
Figure 1C:
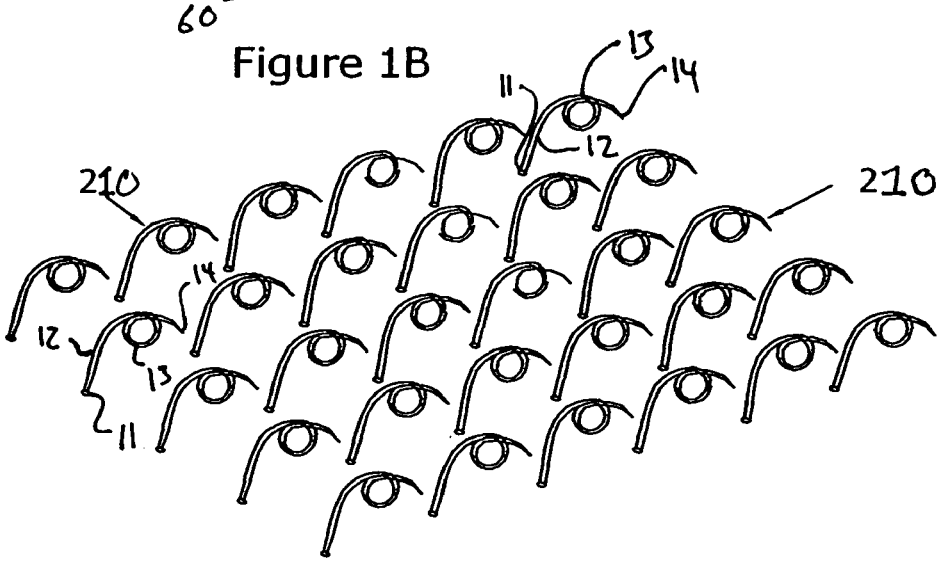
FIG. 1C is a perspective view of the spines of alternative shape having alternative rolled portions near the ends of the spines.
Figure 8A:
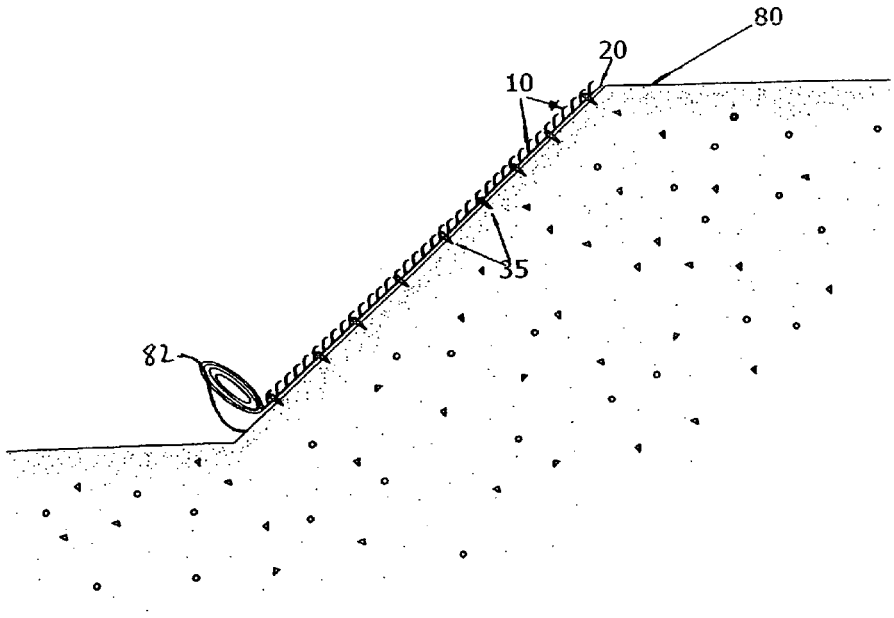
FIG. 8A is a cross-sectional, side view of the spines of the present invention attached to a support structure and rolled out and anchored in a sloping portion of the ground.
Figure 8B:
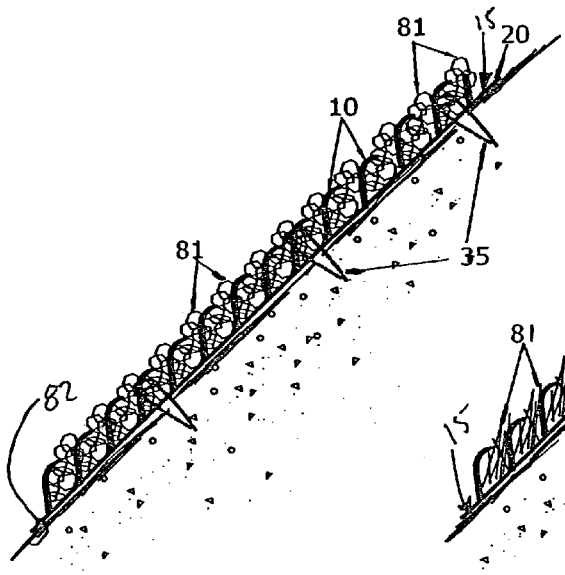
FIG. 8B is a cross-sectional, side view of the spines of the present invention attached to a support structure and rolled out and anchored in a sloping portion of the ground. The present invention is shown holding bark on the slope.
Figure 8C:
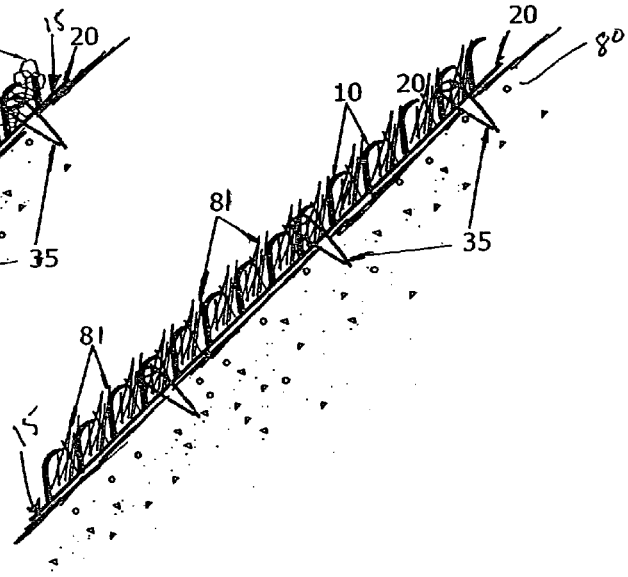
FIG. 8C is a cross-sectional, side view of the spines of the present invention attached to a support structure and rolled out and anchored in a sloping portion of the ground. The present invention is shown holding hay on the slope.

With initial reference to FIG. 1A, the spines 10 are shown unattached to an underlying support structure 15. This figure depicts the spines 10 with sickle shaped curvatures near the distal ends 14 of the spines 10. FIG. 1B depicts alternatively shaped spines 110 having rolled, curled or helix portions near their ends 14. FIG. 1C depicts alternatively shaped spines 210 having an alternatively shapes rolls, curls or helixes near the ends 14 of the spines 10. The spine shapes 10, 110 and 210 depicted in FIGS. 1A, 1B and 1C show some but not all possible configurations for the spines 10, 110 and 210 of the present invention. Although a curvature at the end of the spine 10 is preferred, especially for capturing fibrous landscaping materials like gorilla bark, it is not necessary to the present invention. The purpose of the spines 10 is to capture and retain materials 81 on the underlying support structure 15 so as to hide the underlying support structure 15. This is done by trapping and holding the material 81 as shown in FIGS. 8B and 8C.

Figure 2A:
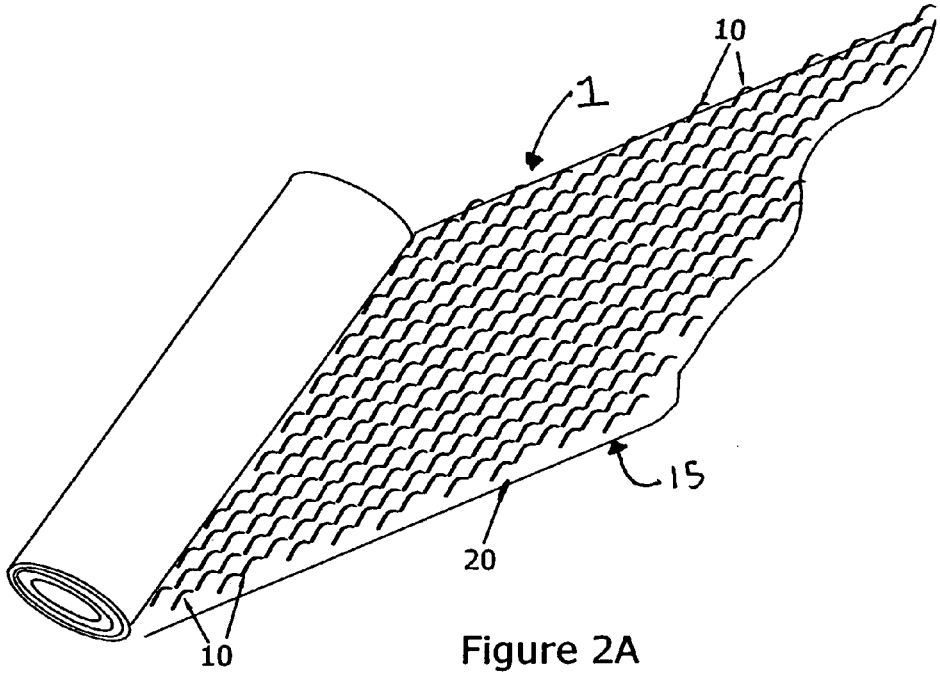
FIG. 2A is a perspective view of the spines of the present invention attached to landscape fabric.

As shown in FIG. 2A, the present invention consists of a landscape/erosion control structure 1 for retaining landscaping materials 81. The landscape/erosion control structure 1 has a lower support structure 15. A plurality of spines 10 are attached to the lower support structure 15, each of the plurality of spines 10 being formed with a base end 11, a base portion 12, an elongated distal portion 13, and a distal end 14. In the present invention, the spines 10 are arranged in relation to each other and to the lower support structure 15 such that spaces exist between most of the distal portions 13 of the spines 10. These spaces allow landscaping materials 81 to become trapped by the spines 10. In the present invention, the spines 10 are relatively stiff such that the distal ends 14 of the spines 10 stand away from the lower support structure 15 when in a rest position. This again allows landscaping materials 81 to fall into the spaces around the spines 10 and become trapped by the spines 10.

In the present invention, it is preferred that a substantial number of the distal ends 14 of the spines 10 do not touch other spines 10. This also best allows landscaping materials 81 to fall into the spaces around the spines 10 and become trapped by the spines 10. Also, in the preferred embodiment of the present invention, the distal portions 13 of the spines 10 have a designated width and the spaces between the distal portions 13 of adjacent spines 10 is substantially greater than the width of the spines 10. It is an object of the present invention to hide the landscape/erosion control structure from view by covering it with landscaping materials 81. By creating stiff and relatively narrow spines in relation to the space between the spines, the chances are better that landscaping materials 81 spread out on the landscape/erosion control structure 1 will completely surround and hide the spines 10 and completely cover the lower support structure 15. The base end 11 of the spine is preferably approximately 0.5 mm to 1 mm wide.

In the preferred embodiment, when the plurality of spines 10 are in their rest position, the distal portions 13 of most of the spines 10 are disposed at an acute angle or are disposed substantially parallel to the lower support structure 15. The inventors believe that the present invention will find particular use in helping to cover a sloped surface 82 with landscaping materials 81, and by disposing the top portions of the spines 10 at an angle to the lower support structure 15 the spines 10 will better be able to hold landscaping materials 81 on the sloped surface.

In the preferred embodiment of the present invention, the spines 10 are arranged in discrete rows 60.

Also, in the preferred embodiment, the elongated distal portions 13 of the spines 10 are generally directed in a similar direction. In use, the spines 10 will be directed up the face of the sloped surface 82. This way when a piece of landscaping material 81 pushes up against the spine 10, it will be pushing the spine 10 out of its rest position. If the spine 10 was directed down the slope a piece of landscape material 81 might just push the spine 10 down towards the lower support structure 15, and the piece of landscaping material 81 might just roll over the spine 10.

By having the elongated distal portions of the spines 13 directed or oriented in the same direction this also makes it easy to spread landscape materials 81 over the landscape/erosion control structure 1 using a rake. Because the spines 10 have discrete distal ends 14, and are not loops, they cannot grab the prongs of a rake, and by directing the spines 10 in the same direction it is easier to remove materials from the spines 10, if one wants to change the landscape materials 81 or use the landscape/erosion control structure 1 elsewhere.

Figure 6A:
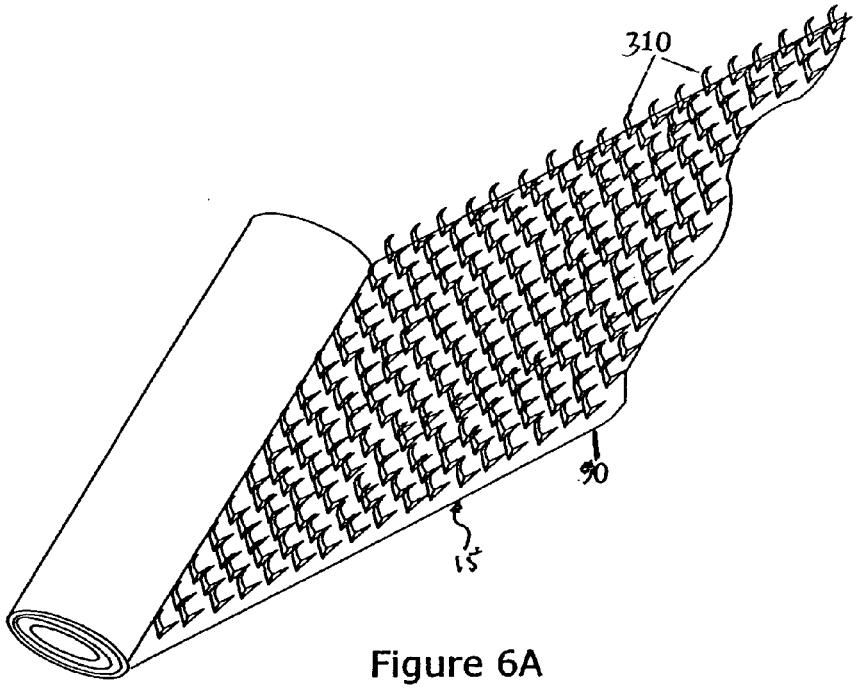
FIG. 6A is a perspective view of the spines of the present invention cut out from a sheet of material and bent to desired angle in an alternate embodiment.
Figure 6B:
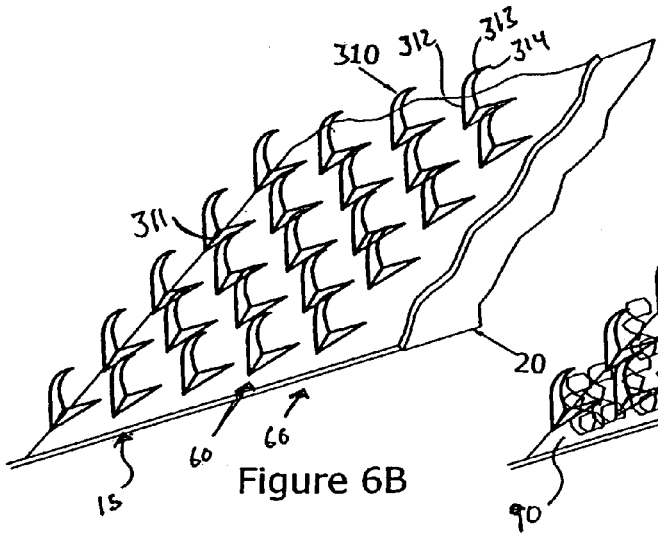
FIG. 6B is a perspective view of the cut out spines attached to a landscape fabric.
Figure 6C:
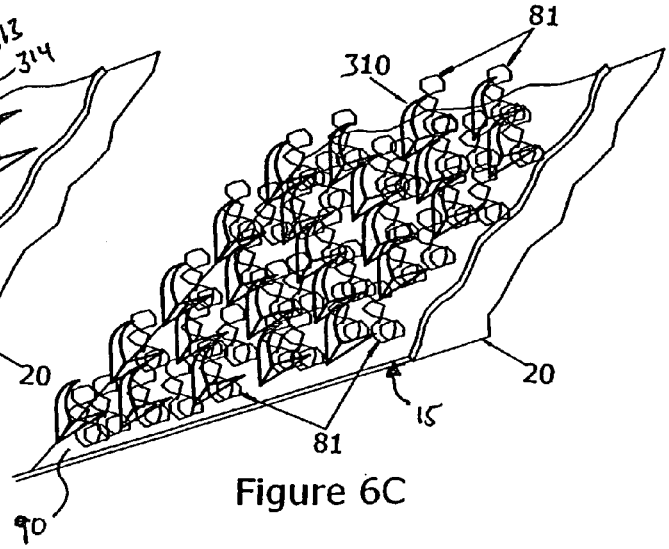
FIG. 6C is a perspective view of the cut out spines attached to a landscape fabric. The spines are shown trapping landscape material on the landscape fabric.

As is best shown in the embodiment shown in FIGS. 6A, 6B, and 6C, the landscape/erosion control structure 1 is formed with spines 310, wherein the base portions 12 of the spines 310 are wider than the elongated distal portions 313 of the spines 310, and the distal ends 314 of the spines 310 come to a point. It is preferred that the spines 310 be wider at their base portions 312 for making a strong attachment to the lower support structure 15, while being narrow at their distal ends 314, so it is more difficult to see their distal ends 314, should the distal end 314 of a spine 310 protrude above the landscape material.

As is shown in FIGS. 6A, 6B and 6C, the spines 10 can be formed with a triangular shape, having a base 311, base portion 312, elongated distal portion 313 and distal end 314.

It is believed by the inventors that if the distal portions 13 of the spines 10 are curved that spines 10 will better be able to hold landscape materials 81. In fact, the spines 10, can be so curved as to actually be curled as show in FIGS. 1B and 1C.

In the preferred embodiment, the spines 10 are preferably 2–3 inches long. This allows them to capture sufficient landscape material 81 to ensure that the lower support structure 15 is adequately hidden, and it also allows the spines to capture most size and types of landscape materials 81. The spines could be longer or shorter, and are preferably longer if the spines are formed with curls. It is contemplated that the spines could be as short as 0.5 inches and still capture sufficient landscaping material 81 to completely cover the lower support structure 15.

In operation, the spines 10 can be attached to a variety of materials such as landscape fabric 20, open mesh weave 40, open mat 50 or other similar materials. The spines 10 are particularly useful for capturing and retaining a variety of materials 81 on the support structure 15, when the support structure 15 is disposed on a sloped surface 82.

The spines 10 may be of varying or uniform length. The spines 10 are preferably spaced apart from each other to allow the landscaping material 81 to surround and hide the spines 10, but the spines 10 are also close enough to each other to perform the desired function of capturing and retaining materials 81 on the support structure 15.

Preferably, the field or matrix of spines 10 is laid out in a series of rows 60. The rows 60 are preferably spaced uniformly from each other. Also, in the preferred arrangement of the spines 10, spines 10 in adjacent rows 60 are not in alignment but alternate as in the manner of the black squares on a chess board. As shown in FIGS. 1A, 1B, and 1C, spines 10, 110 and 210 in adjacent rows 60 are staggered. The spines 10 in adjacent rows 60 are preferably staggered by half the distance between adjacent spines 10 in the same row 60.

In the preferred embodiment, for most types of landscape material 81, there is approximately two inches between the base 11 of a spine 10 and the base 11 of any adjacent spine 10. This two inches in spacing is close enough to avoid gapping in the coverage of the landscape material 81 held by the spines 10, while being far enough to allow for the maximum capture of landscape materials 81. In the present invention, the landscape material 81 is allowed to sit on or reach the support structure 15, rather than just resting on the top of the spines 10. Other spacing of the spines 10 is also possible, and the optimum spacing of the spines 10 depends in great part on the size, form and consistency of the landscape material 81.

Spacing between the bases 11 of the spines 10 in the range of 1 inches to 3 inches is possible for most landscaping materials 81. Smaller spacing of the spines 10 makes it difficult for the landscaping material 81 to nest in between the spines 10, and larger spacing between the spines makes it easier for gaps or bare spots in the landscaping material 81 to develop. The spines could also be so close that there is little distance between the bases 11 of the spines 10, but that is not preferred for most landscaping materials 81.

Any known means of securing the spines 10 to the landscape fabric 20, mesh 40 or open mat 50 or other support structure 15 may be used. Such means of securing the spines 10 include gluing, thermal bonding, adhesive bonding, mechanical fasteners, extrusion manufacturing processes, and sonic welding. The preferred method of attachment of spines to landscape fabric 20 is by extruding them out of the landscape fabric material 20. The preferred method of attachment of spines to mesh 40 is also by extruding them out of the mesh 40. The preferred method of attachment of spines to an open mat 50 is also by extruding them out of the mat 50. Any method can be used to form the spines 10 out of the support structure 15 or attach the spines 10 to the support structure 15, so long as the spines 10 stay attached to the landscape fabric 20, mesh 40 or mat 50 or other similar materials during storage, installation and prolonged use in its intended environment.

In the embodiment depicted in FIG. 2A, the spines 10 are attached to a landscape fabric 20. The landscape fabric 20 is of material that substantially blocks the transmission of light as to not allow growth of vegetation disposed beneath the landscape fabric 20. The landscape fabric 20 is preferably formed in sheets of predetermined length, width and thickness. The width and length of the underlying support structure 15 should be determined according to factors relating to both the manufacture, storage and shipping of the erosion control structure 1 and to the deployment of the erosion control structure 1. Obviously, when the present invention is used by homeowners who have small areas of land and smaller places of storage and smaller means of transport then the erosion control structure will be provided in smaller rolls, for example rolls from 3 to 5 feet wide and 100 to 300 feet long. When the erosion control structure is used by commercial landscapers the rolls could be very large and very long, for example 10 to 20 feet wide and 500 to 1000 feet long. The landscape fabric 20 is preferably made of UV resistant, high-density polyethylene that is 3–6 millimeters thick. The sheet of landscape fabric 20 preferably has the capability to allow water to pass through the membrane of the fabric 20 through micro pores. This avoids ponding of water in flat areas. The preferred landscape fabric 20 also has a rough surface, that could be produced by short filaments or fibers, if the fabric is a woven material. The preferred landscape material 20 is also dull and not shiny so it is more inconspicuous.

Figure 2B:
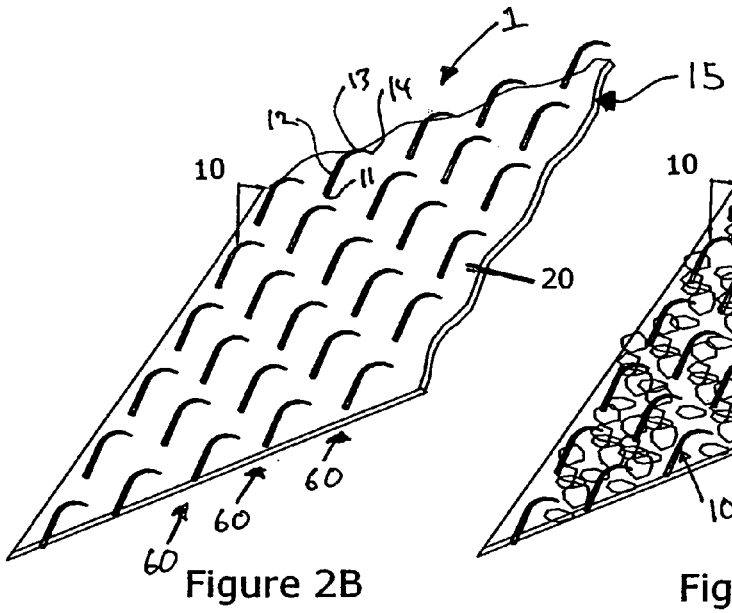
FIG. 2B is a perspective view of the landscape fabric showing the spines attached to the fabric.
Figure 2C:
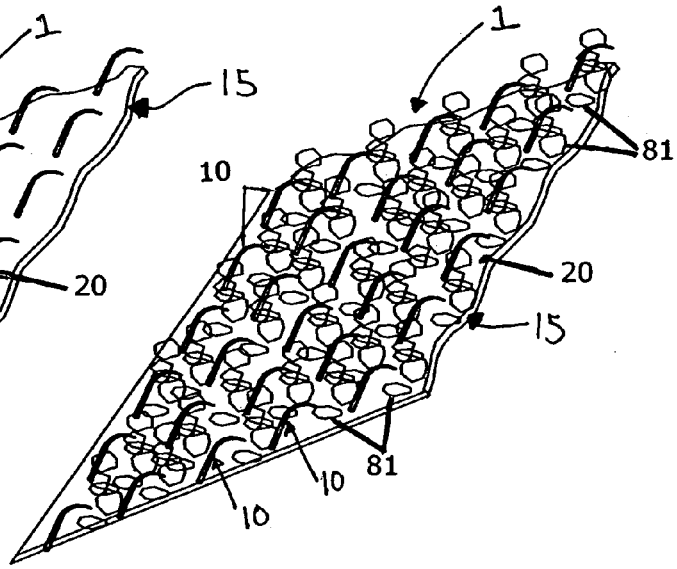
FIG. 2C is a perspective view of the spines of the present invention trapping mulch.

In FIGS. 2A & 2B, the spines 10 are shown placed in a uniform manner on the fabric 20, without the staggering of adjacent rows 60. The spines 10 may be of similar length or of varying lengths depending upon the material 81 to be retained. Larger spines 10 may be spaced at greater distances on the fabric 20 and can be used to trap larger material 81 such as large grade landscape bark, which is approximately 50–100 mm in diameter. Smaller spines 10 spaced at closer distances on the fabric 20 would be used to trap small grade landscape bark, which is approximately 15 mm in diameter. Small grade landscape bark 81 includes shredded bark or straw.

One possible method of attachment of the spines 10 to the landscape fabric 20 is by an extrusion manufacturing process where the spines 10 are pulled out or extruded from the same material as the landscape fabric 20. Another method is by attaching the spines 10 to the fabric 20 with glue or adhesive.

In the preferred use, the desired length of the landscape fabric 20 is rolled out over the sloped area or surface 82 to be landscaped. See FIG. 8A . The landscape fabric 20 carrying the spines 10 can be anchored to the ground 80 by placing pegs 35 in preformed holes 26 in the landscape material 20 or by puncturing through the landscape material 20. Holes may be cut into the landscape fabric 20 to accommodate trees, plants or other obstacles. Landscape bark 81 or another similar material is then placed onto the landscape fabric 20, and the spines 10 retain the landscape material 81. If necessary, an additional length or lengths of the landscape fabric 20 may be placed in side-by-side relation to insure total coverage.

The sheets can be anchored to the slope by placing pegs 35 in preformed holes 26 in the material or by puncturing through the lower support structure 15. The pegs are preferably strong, yet lightweight plastic that will not degrade and have a rounded and wide interface with the lower support structure 15 to prevent ripping of the lower support structure 15.

Figure 7A:
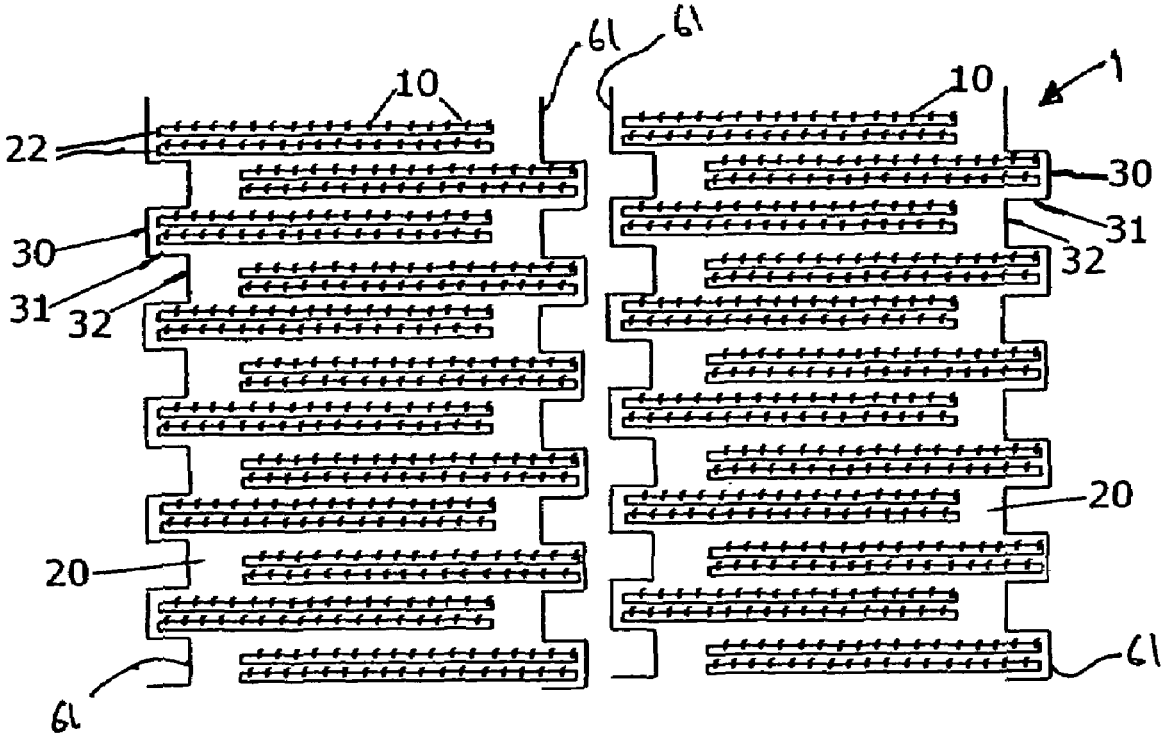
FIG. 7A is a plan view before placement of two sheets of landscape fabric. The edges of the fabric have been contoured and the spines laid out in a manner to prevent gaps in the spines.
Figure 7B:
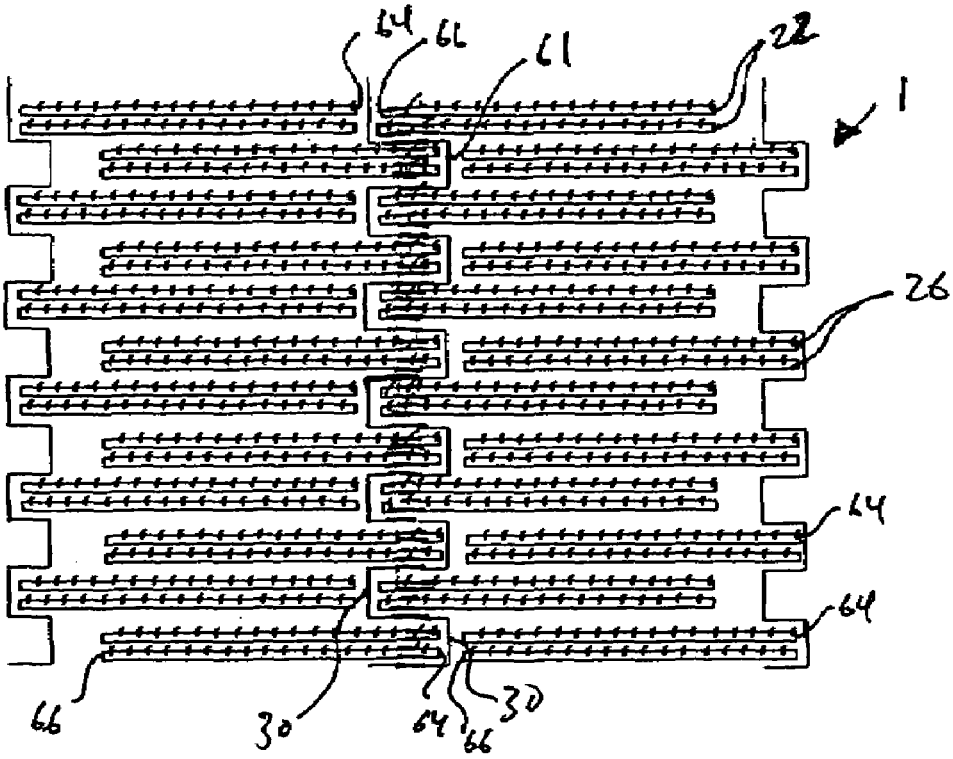
FIG. 7B is a plan view of two sheets of landscape fabric placed side by side.

As shown in FIGS. 7A and 7B, one or more of the outer peripheral edges 61 of the support structure 15 can be constructed so as to have protruding sections 30 alternating with notches 32. As shown in FIG. 7A, the side edge 31 of protruding section 30 is also the side edge 31 of notch 32. In the preferred embodiment, the length of the notches 32 and protruding sections 30 is greater than 2 inches, or in the specific embodiment shown in FIGS. 7A and 7B can accommodate two strips 22 carrying spines 10.

As shown in FIGS. 7A and 7B, two opposed edges 61 of the landscape material 20 can be formed with alternating protruding sections 30 and notches 32, and the spines 10 are arranged so as to extend almost to the edges of the protruding sections 30, but stop short of the notches 32. In this manner, when adjacent support structures 15 are arranged side-by-side, the sheets can be disposed so that the protruding sections 30, having spines 10, of one support structure 15 lie on top of a corresponding section of the adjacent support structure 15 where there is a notch and no spines 10. In this manner, gapping of the spines 10 is avoided, and also spines 10 of one support structure 15 are not disposed on top of the spines 10 of an adjacent support structure 15, creating a bulge or high spot in the support structure 15. While FIGS. 7A and 7B show spines 10 carried on strips 22, the overlapping of adjacent support structures 15 is possible without the spines 10 being carried on strips 22.

Figure 3A:
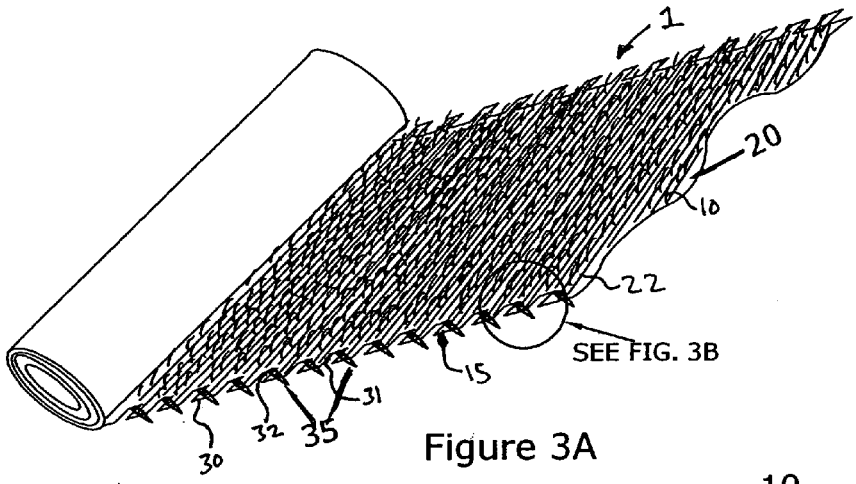
FIG. 3A is a perspective view of the spines of the present invention attached to an alternate support structure. The support structure is a series of substantially parallel strips. The spines are attached to the strips and the strips are attached to the landscape fabric.

As shown in FIGS. 3A and 7A, the landscape/erosion control structure 1 can be made a lower support structure 15 that has a plurality of strips 22 that carry the spines 10, and the plurality of strips are joined together. As shown in FIGS. 3A and 7A the strips 22 can be joined together by the landscape fabric material 20.

The plurality of strips 22 that carry the spines 10 can be elongated and arranged in substantially parallel relationship. Each of the strips 22 that carry the spines has a first end 64 and a second end 66.

In the preferred embodiment of the invention, selected pairs of adjacent strips 22 that carry the spines 10 are arranged so that the first end 64 of the first one of said strips 22 making up the selected pair of adjacent strips 22 is not in alignment with the first end 64 of the second strip 22 of the selected adjacent pair of strips 22, and these pairs of offset adjacent strips occur at regular intervals as shown in FIG. 7A.

When a similar second landscape/erosion control structure 1 is placed alongside the first, this arrangement of offset ends of strips 22 can be used to allow continuity of the spines 10 between adjacent landscape erosion control structures 1. As shown in FIG. 7A, the second landscape/erosion control structure 1 is disposed next to the first landscape/erosion control structure so that the second ends 66 of the strips 22 carrying the spines 10 of the first landscape/erosion control structure 1 are adjacent to the first ends 64 of the strips 22 carrying the spines 10 of the second landscape/erosion control structure 1.

FIG. 3A, also shows spines 10 attached to a landscape fabric 20. The description of the properties of the landscape fabric 20 is similar to that described above and is not repeated. In the embodiment shown in FIG. 3A, the spines 10 are attached to the fabric 20 by employing a series of strips 22 where the spines 10 are attached to the strips 22 by a variety of methods, such as an extrusion manufacturing process where the spines are pulled out or extruded from the same material as the strips 22 or by attaching the spines 10 to the strips 22 with glue or adhesive. The strips 22 are preferably attached to the landscape fabric 20 by means of a second strip 25 of approximately equal width and length that has pegs 24 which are received in holes 23 in the strips 22 carrying the spines 10. The landscape fabric 20 is sandwiched between the strips 22 and 25 and the pegs 24 are sonic or heat welded into the holes 23, preferably heat welded. The pegs 24 could also be placed on the strip 22 carrying the spines 10, and those pegs 24 could be inserted in openings or holes 23 in the second strip 25.

In the preferred embodiment, the plurality of strips 22 carrying the spines 10 are substantially equidistantly spaced from each other. The spacing of the spines 10 along a strip need not be uniform, although in the preferred embodiment spines 10 are placed substantially equidistant from each other along the strip 22 carrying said spines 10. Also, in the preferred embodiment, spines 10 on adjacent strips 22 are offset from each other such that the spines 20 on adjacent strips 22 are staggered. In the preferred embodiment, the spines 10 are staggered by one-half of the distance between spines 10 on the same strip 22.

As shown in FIG. 3A, the edges 61 of the lower support structure 15 having the protruding section 30 and the notches 32 can be disposed orthogonal to the direction in which the spines 10 are angled. The spines 10 are preferably angled so they point up the sloped surface 82.

Figure 3B:
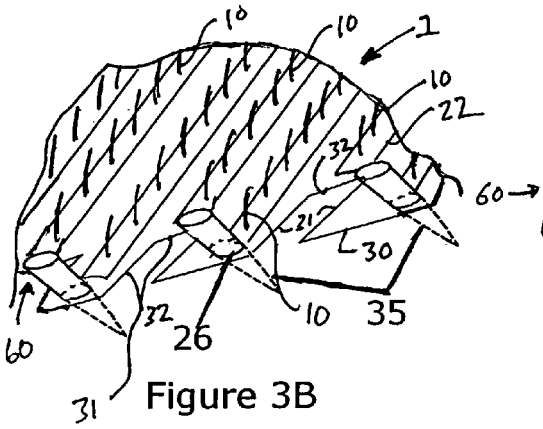
FIG. 3B is an enlarged view of the area shown as 3B in FIG. 3A.
Figure 3C:
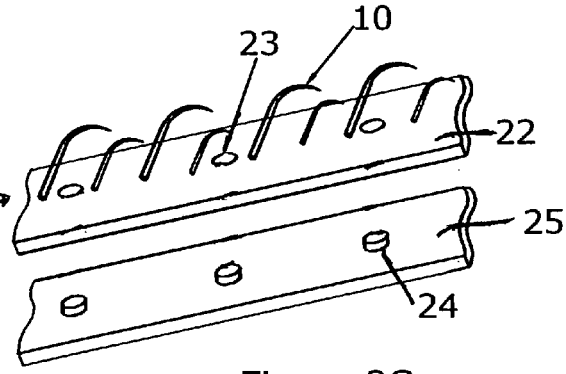
FIG. 3C is a perspective view of the spines attached to a top strip. The top strip is shown with holes for receiving the bottom strip, which is shown with pegs which are received in the holes of the top strip.
Figure 3D:
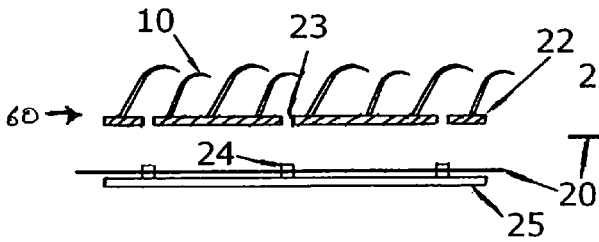
FIG. 3D is a side view of the spines of the present invention before final assembly with the landscape fabric sandwiched between the top strip to which the spines are attached and the bottom strip.
Figure 3E:
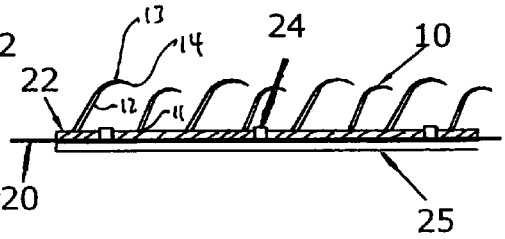
FIG. 3E is a side view after assembly of the landscape fabric sandwiched between the top strip to which the spines are attached and the bottom strip.

The spines 10 may be of similar length or of varying lengths depending upon the material 81 to be retained. As shown in FIG. 3B, the spines 10 can be of alternating height.

In use, the desired length of the landscape fabric 20 is rolled out over the sloped area to be landscaped. See FIG. 8A. The landscape fabric 20 carrying the spines 10 can be anchored to the ground 80 by placing pegs 35 in preformed holes 26 in the landscape material 20 or by puncturing through the landscape material 20. Holes may be cut into the landscape fabric 20 to accommodate trees, plants or other obstacles. Landscape bark 81 or another similar material is then placed onto the landscape fabric, and the spines 10 retain the landscape material 81. If necessary, an additional length or lengths of the landscape fabric 20 may be placed in side-by-side relation to insure total coverage.

Figure 4A:
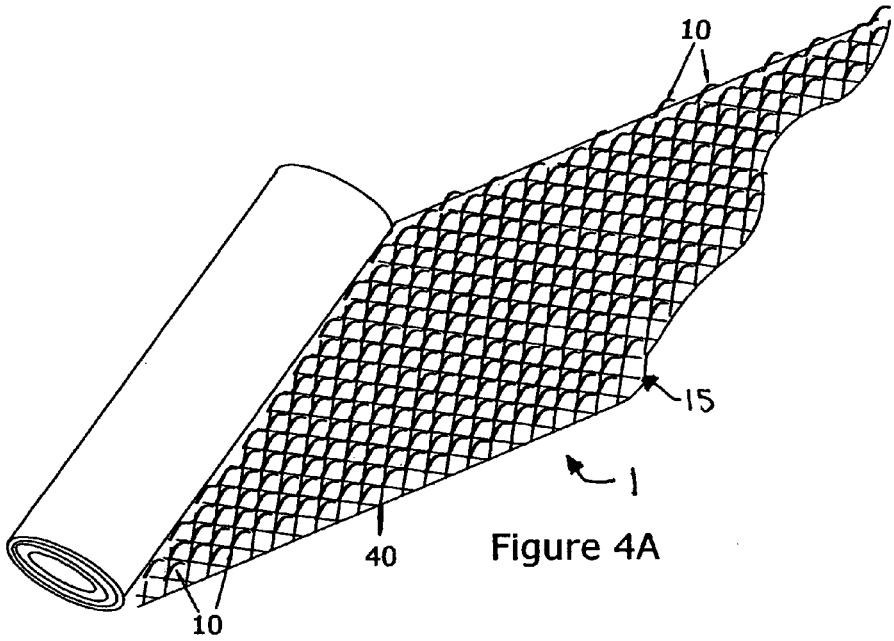
FIG. 4A is a perspective view of the spines of the present invention attached to an open mesh weave in an alternate embodiment.
Figure 4B:
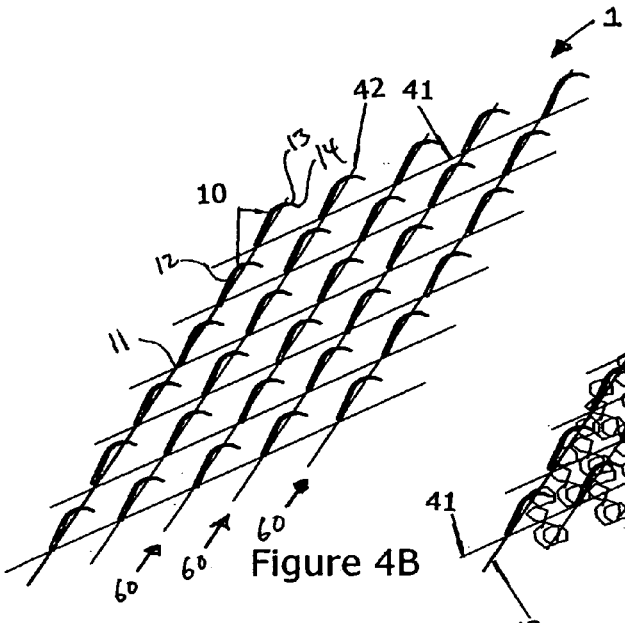
FIG. 4B is a perspective view of the open mesh weave showing the spines attached to the open mesh weave.
Figure 4C:
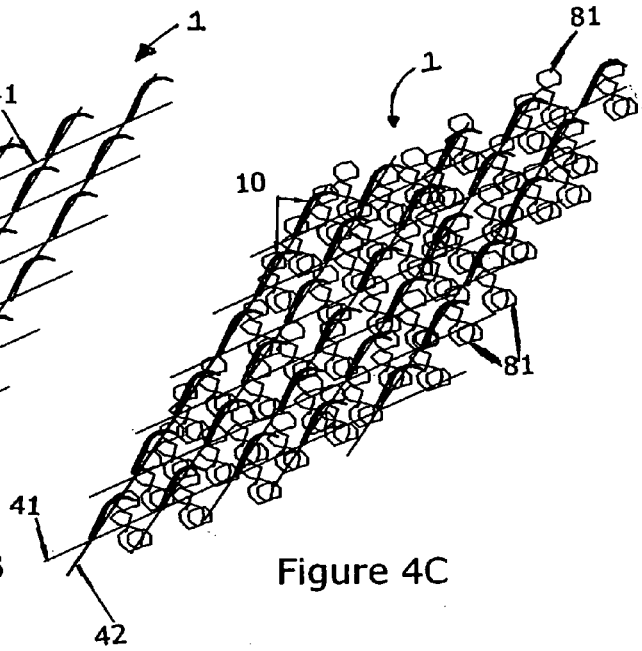
FIG. 4C is a perspective view of the open mesh weave showing the spines attached to the open mesh weave, trapping landscape material.

In the embodiment depicted in FIG. 4A, the spines 10 are attached to an open mesh weave 40. The open mesh weave material 40 does not necessarily block the transmission of sunlight or disallow growth of plants underneath the open mesh weave material 40. The open mesh weave material 40 is preferably formed in sheets of predetermined length, width and thickness. As better shown in FIG. 4B, the open mesh weave material 40 is preferably made of a unitary single-layered, flexible, UV resistant material, formed in a weave. The open mesh weave material 40 has a warp 41 and a woof 42 pattern. The warp 41 and woof 42 spacing on the material 40 can vary, although spacing between the warp members 41 and the woof members 42 is preferably uniform.

The spines 10 may be of similar length or of varying lengths depending upon the landscape material 81 to be retained. One possible method of attaching the spines 10 to the open mesh weave 40 is by an extrusion manufacturing process where the spines 10 are pulled out or extruded from the same material as the open mesh weave 40. Another method of attaching the spines 10 to the open mesh weave 40 is with glue or adhesive. To add strength to the product, the spines 10 are preferably located at the junction of the warp 41 and woof 42 on the mesh 40.

The desired length of the open mesh material 40 is rolled out and laid over the sloped area with the spines 10 pointing toward the sky. As shown in FIG. 8A, spines 10 with bent portions are preferably formed with the bent portions near the ends 14 of the spines 10 being disposed to point up the sloped surface 82.

The open mesh weave material 40 can be anchored to the ground by placing pegs 35 in the open spaces 57 on the weave 40. The primary purpose of using spines 10 with an open mesh material 40 is to retain straw or similar material 81 to protect the sloped surface from erosion and the sudden flow of storm water.

Figure 5A:
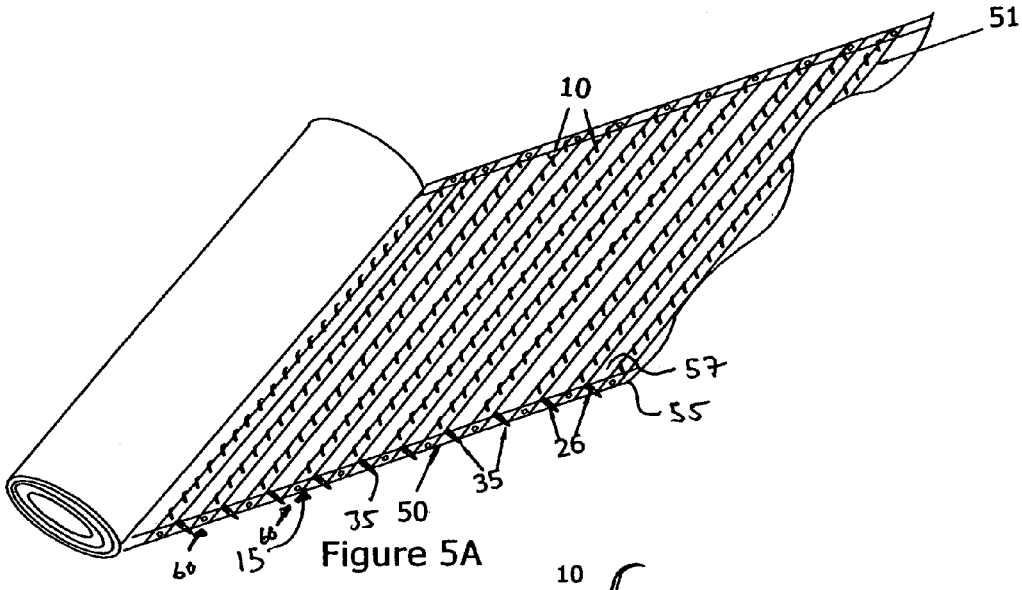
FIG. 5A is a perspective view of the spines of the present invention attached to an open mat in an alternate embodiment using a series of strips where the spines are attached to the strips.
Figure 5B:
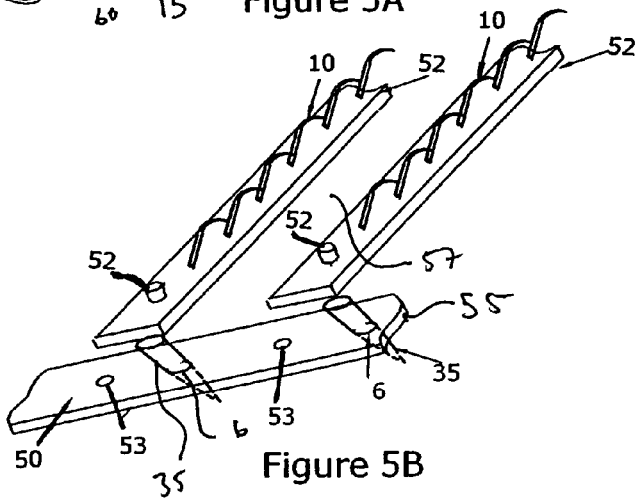
FIG. 5B is a perspective view of the open mat before assembly, showing the spines attached to horizontal strips which have pegs at the ends of the strips and the side strips which have holes meant to receive the pegs of the horizontal strips.
Figure 5C:
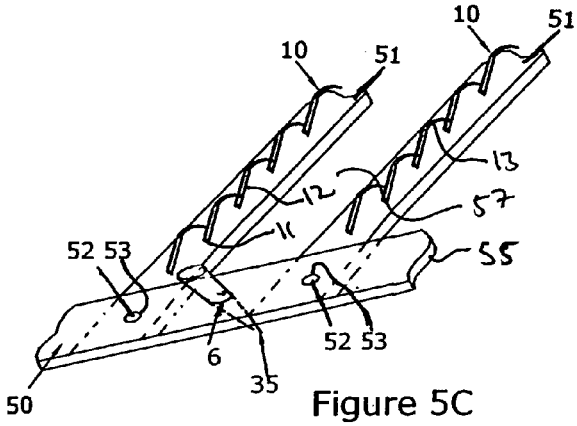
FIG. 5C is a view after assembly of the open mat showing the pegs on the horizontal strips received in the holes in the side strips forming the open mat.

In the embodiment depicted in FIG. 5A, the spines 10 are attached to an open mat 50. The open mat 50 does not necessarily block the transmission of sunlight or disallow growth of plants disposed underneath the open mat 50. The open mat 50 is preferably formed in sheets of predetermined length, width and thickness. The open mat 50 is preferably made of a unitary, single-layered, flexible, UV resistant material, formed from a plurality of substantially parallel strips 51 carrying spines 10 joined together at their ends by edge strips 55.

The spines 10 can be attached to the strips 51 by a variety of methods such as an extrusion manufacturing process where the spines 10 are pulled out or extruded from the same material as the strips 51 or by attaching the spines 10 to the strips 51 with glue or adhesive. The strips 51 are preferably attached to the side strips 55 by means of pegs 52 in the parallel strips 51 which are received in holes 53 in the side strips 55, and the arrangement of the pegs 52 and the openings 53 can be reversed. The pegs 52 are sonic or heat welded into the holes 53, preferably heat welded.

The desired length of the open mat 50 is rolled out and laid over the sloped area 82. The open mat weave material 50 can be anchored to the ground by placing pegs 35 in the open spaces 57 of the mat 50. The primary purpose of the embodiment shown in FIG. 5A is to retain straw 81 or similar landscape material 81 on a sloped surface 82 for a variety of erosion control or storm water protection applications.

In the embodiment depicted in FIG. 6A, the spines 310 are cut out from a top sheet 90 of thick, preferably 20–40 millimeters, UV resistant polyethylene material 90 and bent upward to a desired angle. The top sheet 90 can then be attached to a bottom sheet 20 of equal length and width of landscape fabric if the transmission of light is desired to be blocked.

The description given herein is intended to illustrate the preferred embodiment of the present invention. It will be apparent from the foregoing that various changes may be made in the details of construction and configuration without departing form the spirit of the invention. It is therefore understood that the exemplary embodiments are illustrative and not restrictive of the invention.

What is claimed is:

1. A landscape/erosion control structure for retaining landscaping materials, the landscape/erosion control structure comprising:

a. a lower support structure;

b. a plurality of spines attached to the lower support structure, each of said plurality of spines being formed with a base end, a base portion, an elongated distal portion, and a distal end;

c. wherein the spines are arranged in relation to each other and to the lower support structure such that spaces exist between most of the distal portions of the spines; and d. the spines are relatively stiff such that the distal ends of the spines stand away from the lower support structure when in a rest position and the spines can hold landscape material, and wherein the distal portions of the spines have a designated width and the spaces between the distal portions of adjacent spines is substantially greater than the width of the spines.

2. The landscape/erosion control structure of claim 1, wherein:

a substantial number of the distal ends of the spines do not touch other spines.

3. The landscape/erosion control structure of claim 1, wherein;

when the plurality of spines are in the rest position, the distal portions of most of the spines are disposed at an acute angle to the lower support structure.

4. The landscape/erosion control structure of claim 1, wherein:

said plurality of spines are arranged in discrete rows.

5. The landscape/erosion control structure of claim 1, wherein:

said elongated distal portions of said spines are generally directed in a similar direction.

6. The landscape/erosion control structure of claim 1, wherein:

said distal ends of said spines come to a point.

7. The landscape/erosion control structure of claim 1, wherein:

the distal portions of the spines are curved.

8. The landscape/erosion control structure of claim 1, wherein:

the distal portions of the spines are curled.

9. The landscape/erosion control structure of claim 1, wherein:

the distal portions of the spines are angled nearly parallel to the lower support structure.

10. The landscape/erosion control structure of claim 1, wherein:

the lower support structure is landscape fabric material and the landscape fabric material substantially blocks the transmission of sunlight through the landscape fabric material.

11. The landscape/erosion control structure of claim 1, wherein:

the lower support structure does not block the transmission of sunlight.

12. The landscape/erosion control structure of claim 1, wherein:

a. said lower support structure comprises a plurality of strips that carry the spines;

b. said plurality of strips being joined together.

13. A landscape/erosion control structure for retaining landscaping materials, the landscape/erosion control structure comprising:

a. a lower support structure;

b. a plurality of spines attached to the lower support structure, each of said plurality of spines being formed with a base end, a base portion, an elongated distal portion, and a distal end;

c. wherein the spines are arranged in relation to each other and to the lower support structure such that spaces exist between most of the distal portions of the spines;

d. the spines are relatively stiff such that the distal ends of the spines stand away from the lower support structure when in a rest position; and e. said base portions of said spines are wider than said elongated distal portions.

14. The landscape/erosion control structure of claim 13, wherein:

said spines have a triangular shape.

15. A landscape/erosion control structure for retaining landscaping materials, the landscape/erosion control structure comprising:

a. a lower support structure;

b. a plurality of spines attached to the lower support structure, each of said plurality of spines being formed with a base end, a base portion, an elongated distal portion, and a distal end;

c. wherein the spines are arranged in relation to each other and to the lower support structure such that spaces exist between most of the distal portions of the spines;

d. wherein the spines are relatively stiff such that the distal ends of the spines stand away from the lower support structure when in a rest position; and e. wherein said lower support structure comprises a plurality of strips that carry the spines, said plurality of strips being joined together;

f. a plurality of second strips that do not have spines;

g. a sheet of landscape fabric material; and h. said sheet of landscape fabric material is disposed between said plurality of strips that carry the spines and the plurality of second strips that do not have spines.

16. The landscape/erosion control structure of claim 15, wherein:

said second strips have pegs which are received in holes in the strips carrying the spines.

17. A landscape/erosion control structure for retaining landscaping materials, the landscape/erosion control structure comprising:

a. a lower support structure;

b. a plurality of spines attached to the lower support structure, each of said plurality of spines being formed with a base end, a base portion, an elongated distal portion, and a distal end;

c. wherein the spines are arranged in relation to each other and to the lower support structure such that spaces exist between most of the distal portions of the spines;

d. wherein the spines are relatively stiff such that the distal ends of the spines stand away from the lower support structure when in a rest position;

e. wherein said lower support structure comprises a plurality of strips that carry the spines, said plurality of strips being joined together;

f. wherein said plurality of strips that carry the spines are elongated and are arranged in substantially parallel relationship;

g. wherein each of said plurality of strips that carry the spines has a first end and a second end; and h. wherein selected pairs of adjacent strips that carry the spines are arranged so that the first end of the first one of said strips making up the selected pair of adjacent strips is not in alignment with the first end of the second strip of the selected adjacent pair of strips.

18. The landscape/erosion control structure of claim 17, wherein:

selected adjacent pairs of strips occur at regular intervals along the lower support structure.

19. The landscape/erosion control structure of claim 18, further comprising:

a. a second landscape/erosion control structure comprising:

1. a lower support structure;

2. a plurality of spines attached to the lower support structure, each of said plurality of spines being formed with a base end, a base portion, an elongated distal portion, and a distal end;

3. wherein the spines are arranged in relation to each other and to the lower support structure such that spaces exist between most of the distal portions of the spines, and the spines are relatively stiff such that the distal ends of the spines stand away from the lower support structure when in a rest position; and 4. said lower support structure comprises a plurality of strips that carry the spines, said plurality of strips being joined together, said plurality of strips that carry the spines are elongated and are arranged in substantially parallel relationship, each of said plurality of strips that carry the spines having a first end and a second end, and selected pairs of adjacent strips that carry the spines are arranged so that the first end of the first one of said strips making up the selected pair of adjacent strips is not in alignment with the first end of the second strip of the selected adjacent pair of strips, and the selected adjacent pairs of strips occur at regular intervals along the lower support structure; and wherein b. the first and second landscape/erosion control structures are arranged so that the second ends of the strips carrying the spines of the first landscape/erosion control structure are adjacent to the first ends of the strips carrying the spines of the second landscape/erosion control structure.

20. A landscape/erosion control structure for retaining landscaping materials, the landscape/erosion control structure comprising:

a. a lower support structure;

b. a plurality of spines attached to the lower support structure, each of said plurality of spines being formed with a base end, a base portion, an elongated distal portion, and a distal end;

c. wherein the spines are arranged in relation to each other and to the lower support structure such that spaces exist between most of the distal portions of the spines;

d. the spines are relatively stiff such that the distal ends of the spines stand away from the lower support structure when in a rest position;

e. a substantial number of the distal ends of the spines do not touch other spines; and f. the distal portions of the spines have a designated width and the spaces between the distal portions of adjacent spines is substantially greater than the width of the spines.

21. The landscape/erosion control structure of claim 20, wherein;

when the plurality of spines are in the rest position, the distal portions of most of the spines are disposed at an acute angle to the lower support structure.

22. The landscape/erosion control structure of claim 21, wherein:

said elongated distal portions of said spines are generally directed in a similar direction.

23. The landscape/erosion control structure of claim 22, wherein:

the distal portions of the spines are curved.

24. The landscape/erosion control structure of claim 23, wherein:

the distal portions of the spines are curled.

25. The landscape/erosion control structure of claim 24, wherein:

the lower support structure is landscape fabric material and the landscape fabric material substantially blocks the transmission of sunlight through the landscape fabric material.

26. The landscape/erosion control structure of claim 20, wherein:

said plurality of spines are arranged in discrete rows.

27. The landscape/erosion control structure of claim 20, wherein:

said base portions of said spines are wider than said elongated distal portions.

28. The landscape/erosion control structure of claim 27, wherein:

said spines have a triangular shape.

29. The landscape/erosion control structure of claim 20, wherein:

said distal ends of said spines come to a point.

30. The landscape/erosion control structure of claim 20, wherein:

the distal portions of the spines are angled nearly parallel to the lower support structure.

31. The landscape/erosion control structure of claim 20, wherein:

the lower support structure does not block the transmission of sunlight.

32. The landscape/erosion control structure of claim 20, wherein:

a. said lower support structure comprises a plurality of strips that carry the spines;

b. said plurality of strips being joined together.

33. The landscape/erosion control structure of claim 32, further comprising:

a. a plurality of second strips that do not have spines;

b. a sheet of landscape fabric material; and c. said sheet of landscape fabric material is disposed between said plurality of strips that carry the spines and the plurality of second strips that do not have spines.

34. The landscape/erosion control structure of claim 33, wherein:

said second strips have pegs which are received in holes in the strips carrying the spines.

35. The landscape/erosion control structure of claim 32, wherein:

a. said plurality of strips that carry the spines are elongated and are arranged in substantially parallel relationship;

b. each of said plurality of strips that carry the spines has a first end and a second end; and c. selected pairs of adjacent strips that carry the spines are arranged so that the first end of the first one of said strips making up the selected pair of adjacent strips is not in alignment with the first end of the second strip of the selected adjacent pair of strips.

36. The landscape/erosion control structure of claim 35, wherein:

selected adjacent pairs of strips occur at regular intervals along the lower support structure.

37. The landscape/erosion control structure of claim 36, further comprising:

a. a second landscape/erosion control structure comprising:

1. a lower support structure;

2. a plurality of spines attached to the lower support structure, each of said plurality of spines being formed with a base end, a base portion, an elongated distal portion, and a distal end;

3. wherein the spines are arranged in relation to each other and to the lower support structure such that spaces exist between most of the distal portions of the spines, and the spines are relatively stiff such that the distal ends of the spines stand away from the lower support structure when in a rest position; and 4. said lower support structure comprises a plurality of strips that carry the spines, said plurality of strips being joined together, said plurality of strips that carry the spines are elongated and are arranged in substantially parallel relationship, each of said plurality of strips that carry the spines having a first end and a second end, and selected pairs of adjacent strips that carry the spines are arranged so that the first end of the first one of said strips making up the selected pair of adjacent strips is not in alignment with the first end of the second strip of the selected adjacent pair of strips, and the selected adjacent pairs of strips occur at regular intervals along the lower support structure; and wherein b. the first and second landscape/erosion control structures are arranged so that the second ends of the strips carrying the spines of the first landscape/erosion control structure are adjacent to the first ends of the strips carrying the spines of the second landscape/erosion control structure.

38. The landscape/erosion control structure of claim 20, wherein:

the spines are greater than or equal to 0.5 inches in height.

39. The landscape/erosion control structure of claim 20, wherein:

the spaces between the distal portions of adjacent spines is substantially 2 inches or greater.

40. A landscape/erosion control structure for retaining landscaping materials such as mulch over a selected portion of ground, the landscape/erosion control structure comprising:

a. a lower support structure placed over a selected portion of ground;

b. a plurality of spines attached to the lower support structure, each of said plurality of spines being formed with a base end, a base portion, an elongated distal portion, and a distal end;

c. wherein the spines are arranged in relation to each other and to the lower support structure such that spaces exist between most of the distal portions of the spines;

d. the spines are relatively stiff such that the distal ends of the spines stand away from the lower support structure when in a rest position; and e. mulch placed over the lower support structure and resting on the lower support structure and in contact with the spines, wherein f. said lower support structure comprises a plurality of strips that carry the spines;

g. said plurality of strips being joined together.

41. The landscape/erosion control structure of claim 40, wherein;

when the plurality of spines are in the rest position, the distal portions of most of the spines are disposed at an acute angle to the lower support structure.

42. The landscape/erosion control structure of claim 41, wherein:

said elongated distal portions of said spines are generally directed in a similar direction.

43. The landscape/erosion control structure of claim 42, wherein:

the distal portions of the spines are curved.

44. The landscape/erosion control structure of claim 43, wherein:

the distal portions of the spines are curled.

45. The landscape/erosion control structure of claim 44, wherein:

the lower support structure is landscape fabric material and the landscape fabric material substantially blocks the transmission of sunlight through the landscape fabric material.

46. The landscape/erosion control structure of claim 40, wherein:

said plurality of spines are arranged in discrete rows.

47. The landscape/erosion control structure of claim 40, wherein:

said base portions of said spines are wider than said elongated distal portions.

48. The landscape/erosion control structure of claim 47, wherein:

said spines have a triangular shape.

49. The landscape/erosion control structure of claim 40, wherein:

said distal ends of said spines come to a point.

50. The landscape/erosion control structure of claim 40, wherein:

the distal portions of the spines are angled nearly parallel to the lower support structure.

51. The landscape/erosion control structure of claim 40, wherein:

the lower support structure does not block the transmission of sunlight.

52. The landscape/erosion control structure of claim 40, further comprising:

a. a plurality of second strips that do not have spines;

b. a sheet of landscape fabric material; and c. said sheet of landscape fabric material is disposed between said plurality of strips that carry the spines and the plurality of second strips that do not have spines.

53. The landscape/erosion control structure of claim 52, wherein:

said second strips have pegs which are received in holes in the strips carrying the spines.

54. The landscape/erosion control structure of claim 40, wherein:

a. said plurality of strips that carry the spines are elongated and are arranged in substantially parallel relationship;

b. each of said plurality of strips that carry the spines has a first end and a second end; and c. selected pairs of adjacent strips that carry the spines are arranged so that the first end of the first one of said strips making up the selected pair of adjacent strips is not in alignment with the first end of the second strip of the selected adjacent pair of strips.

55. The landscape/erosion control structure of claim 54, wherein:

selected adjacent pairs of strips occur at regular intervals along the lower support structure.

56. The landscape/erosion control structure of claim 55, further comprising:

a. a second landscape/erosion control structure comprising:

1. a lower support structure;

2. a plurality of spines attached to the lower support structure, each of said plurality of spines being formed with a base end, a base portion, an elongated distal portion, and a distal end;

3. wherein the spines are arranged in relation to each other and to the lower support structure such that spaces exist between most of the distal portions of the spines, and the spines are relatively stiff such that the distal ends of the spines stand away from the lower support structure when in a rest position; and 4. said lower support structure comprises a plurality of strips that carry the spines, said plurality of strips being joined together, said plurality of strips that carry the spines are elongated and are arranged in substantially parallel relationship, each of said plurality of strips that carry the spines having a first end and a second end, and selected pairs of adjacent strips that carry the spines are arranged so that the first end of the first one of said strips making up the selected pair of adjacent strips is not in alignment with the first end of the second strip of the selected adjacent pair of strips, and the selected adjacent pairs of strips occur at regular intervals along the lower support structure; and wherein b. the first and second landscape/erosion control structures are arranged so that the second ends of the strips carrying the spines of the first landscape/erosion control structure are adjacent to the first ends of the strips carrying the spines of the second landscape/erosion control structure.

57. The landscape/erosion control structure of claim 40, wherein:

the spines are greater than or equal to 0.5 inches in height.

58. The landscape/erosion control structure of claim 40, wherein:

the spaces between the distal portions of adjacent spines is substantially 2 inches or greater.

59. A landscape/erosion control structure for retaining landscaping materials such as mulch over a selected portion of ground, the landscape/erosion control structure comprising:

a. a lower support structure placed over a selected portion of ground;

b. a plurality of spines attached to the lower support structure, each of said plurality of spines being formed with a base end, a base portion, an elongated distal portion, and a distal end;

c. wherein the spines are arranged in relation to each other and to the lower support structure such that spaces exist between most of the distal portions of the spines;

d. the spines are relatively stiff such that the distal ends of the spines stand away from the lower support structure when in a rest position; and e. a substantial number of the distal portions of the spines do not touch other spines; and f. the distal portions of the spines have a designated width and the spaces between the distal portions of adjacent spines is substantially greater than the width of the spines.

60. The landscape/erosion control structure of claim 59, wherein;

when the plurality of spines are in the rest position, the distal portions of most of the spines are disposed at an acute angle to the lower support structure.

61. The landscape/erosion control structure of claim 60, wherein:

said elongated distal portions of said spines are generally directed in a similar direction.

62. The landscape/erosion control structure of claim 61, wherein:

the distal portions of the spines are curved.

63. The landscape/erosion control structure of claim 62, wherein:

the distal portions of the spines are curled.

64. The landscape/erosion control structure of claim 63, wherein:

the lower support structure is landscape fabric material and the landscape fabric material substantially blocks the transmission of sunlight through the landscape fabric material.

65. The landscape/erosion control structure of claim 59, wherein:

said plurality of spines are arranged in discrete rows.

66. The landscape/erosion control structure of claim 59, wherein:

said base portions of said spines are wider than said elongated distal portions.

67. The landscape/erosion control structure of claim 66, wherein:

said spines have a triangular shape.

68. The landscape/erosion control structure of claim 59, wherein:

said distal ends of said spines come to a point.

69. The landscape/erosion control structure of claim 59, wherein:

the distal portions of the spines are angled nearly parallel to the lower support structure.

70. The landscape/erosion control structure of claim 59, wherein:

the lower support structure does not block the transmission of sunlight.

71. The landscape/erosion control structure of claim 59, wherein:

a. said lower support structure comprises a plurality of strips that carry the spines;

b. said plurality of strips being joined together.

72. The landscape/erosion control structure of claim 71, further comprising:

a. a plurality of second strips that do not have spines;

b. a sheet of landscape fabric material; and c. said sheet of landscape fabric material is disposed between said plurality of strips that carry the spines and the plurality of second strips that do not have spines.

73. The landscape/erosion control structure of claim 72, wherein:

said second strips have pegs which are received in holes in the strips carrying the spines.

74. The landscape/erosion control structure of claim 71, wherein:

a. said plurality of strips that carry the spines are elongated and are arranged in substantially parallel relationship;

b. each of said plurality of strips that carry the spines has a first end and a second end; and c. selected pairs of adjacent strips that carry the spines are arranged so that the first end of the first one of said strips making up the selected pair of adjacent strips is not in alignment with the first end of the second strip of the selected adjacent pair of strips.

75. The landscape/erosion control structure of claim 74, wherein:

selected adjacent pairs of strips occur at regular intervals along the lower support structure.

76. The landscape/erosion control structure of claim 75, further comprising:

a. a second landscape/erosion control structure comprising:

1. a lower support structure;

2. a plurality of spines attached to the lower support structure, each of said plurality of spines being formed with a base end, a base portion, an elongated distal portion, and a distal end;

3. wherein the spines are arranged in relation to each other and to the lower support structure such that spaces exist between most of the distal portions of the spines, and the spines are relatively stiff such that the distal ends of the spines stand away from the lower support structure when in a rest position; and 4. said lower support structure comprises a plurality of strips that carry the spines, said plurality of strips being joined together, said plurality of strips that carry the spines are elongated and are arranged in substantially parallel relationship, each of said plurality of strips that carry the spines having a first end and a second end, and selected pairs of adjacent strips that carry the spines are arranged so that the first end of the first one of said strips making up the selected pair of adjacent strips is not in alignment with the first end of the second strip of the selected adjacent pair of strips, and the selected adjacent pairs of strips occur at regular intervals along the lower support structure; and wherein b. the first and second landscape/erosion control structures are arranged so that the second ends of the strips carrying the spines of the first landscape/erosion control structure are adjacent to the first ends of the strips carrying the spines of the second landscape/erosion control structure.

77. The landscape/erosion control structure of claim 59, wherein:

the spines are greater than or equal to 0.5 inches in height.

78. The landscape/erosion control structure of claim 59, wherein:

the spaces between the distal portions of adjacent spines is substantially 2 inches or greater.

* * * * *